US006990971B1

(12) United States Patent
Moritz

(10) Patent No.: US 6,990,971 B1
(45) Date of Patent: Jan. 31, 2006

(54) PNEUMATICALLY AMPLIFIED TRIGGER ACTUATOR FOR A GAS OPERATED MARKER GUN

(76) Inventor: Colin Bryant Moritz, 4040 San Felipe Ave., #224, Houston, TX (US) 77027

( * ) Notice: Subject to any disclaimer, the term of this patent is extended or adjusted under 35 U.S.C. 154(b) by 0 days.

(21) Appl. No.: 10/935,388

(22) Filed: Sep. 7, 2004

(51) Int. Cl.
*F41B 11/00* (2006.01)

(52) U.S. Cl. ..... 124/31; 124/73

(58) Field of Classification Search ..... 124/31, 124/73, 74, 75
See application file for complete search history.

(56) References Cited

U.S. PATENT DOCUMENTS

| | | | | |
|---|---|---|---|---|
| 2,652,821 | A * | 9/1953 | Fitch | 124/75 |
| 3,445,069 | A * | 5/1969 | Druge | 239/407 |
| 3,735,747 | A * | 5/1973 | Barjaval | 124/74 |
| 3,788,298 | A | 1/1974 | Hale | |
| 4,457,330 | A | 7/1984 | Fields | |
| 5,503,137 | A | 4/1996 | Fusco | |
| 5,613,483 | A * | 3/1997 | Lukas et al. | 124/73 |
| 5,727,538 | A | 3/1998 | Ellis | |
| 5,915,404 | A | 6/1999 | Satsu | |
| 6,343,599 | B1 | 2/2002 | Perrone | |
| 6,439,217 | B1 | 8/2002 | Shih | |
| 6,520,171 | B2 | 2/2003 | Reible | |
| 6,694,963 | B1 | 2/2004 | Taylor | |
| 6,802,306 | B1 * | 10/2004 | Rice | 124/74 |

OTHER PUBLICATIONS

Hatcher, A.; Assisted Trigger Mechanism; application paper; US.

* cited by examiner

*Primary Examiner*—John A. Ricci
(74) *Attorney, Agent, or Firm*—Sherman D. Pernia

(57) ABSTRACT

The present invention is a pneumatic trigger mechanism intended for use with gas powered projectile guns such as gas powered paintball markers. The present pneumatic trigger mechanism utilizes a specialized pneumatic force amplifier which substantially improves trigger performance and firing cycle time. The pneumatic amplification feature of the present trigger actuator is double acting, in that it provides an increased force advantage for both the firing phase and trigger return phase of the firing cycle. Performance wise, the valving and the pneumatically amplified actuator of the present trigger actuator requires as little about 2 oz. of trigger pull force and as little as 0.01 inch of travel to activate a firing cycle.

10 Claims, 5 Drawing Sheets

PNEUMATICALLY AMPLIFIED TRIGGER ACTUATOR FOR A GAS OPERATED MARKER GUN

FIELD OF THE INVENTION

The present invention is in the field of mechanical guns and projectors in which the projectile impelling apparatus utilizes a nonexplosive propelling agent. Specifically, the present assembly relates to such devices provided with a trigger mechanism which actuates discharge of the device. More specifically the present invention relates to a pneumatically actuated trigger mechanism for such devices.

BACKGROUND OF THE INVENTION

"Paintball" is a currently popular recreational sport in which members of opposite teams attempt to mark opponents with paint, thereby removing them from the game. Marking is accomplished by using a paintball marker gun to shoot a projectile (paintball) containing paint or other appropriate marking material at an opponent. Paintballs are spherical capsules filled with paint or other marking material which burst upon impact. Upon contact with a player, the paintball ruptures, thus marking the player with the contents of the paintball. Once a player is marked, he/she is out of the game.

The paintball gaming industry through the National Paintball Players League (NPPL) has an official set of gaming rules for promoting safety and officially sanctioned play. These rules stipulate that fully automatic marker guns cannot be used in officially sanctioned play. However, there is no limit on the rate of fire for semiautomatic marker guns—semiautomatic being one firing cycle per trigger pull, and only one effective trigger pull per firing cycle. Therefore, the field is motivated to develop marker guns having the highest rate of semiautomatic fire possible. As might be expected, the focus of this development has been on improving trigger mechanisms.

Existing mechanical and pneumatic trigger mechanisms for paintball marker guns, have a trigger pull requiring about 1 lb. of force and nearly ¼" of travel. For examples, see U.S. Pat. Nos. 5,503,137; 6,343,599; and 6,520,171. In an effort to increase the rate of fire, the industry has developed alternatives to the previous mechanical and pneumatic trigger mechanisms that operate electrically. For examples, see U.S. Pat. Nos. 5,727,538; 6,439,217; and 6,694,963. These electric trigger mechanisms have a trigger pull requiring substantially less force and travel than the prior mechanical and pneumatic trigger mechanisms. However, it is possible under certain conditions with electric trigger mechanisms to achieve a firing rate that does not meet the above limitation for a "semiautomatic" rate of fire. In other words, it is possible under these conditions to achieve more than one firing cycle per trigger pull, or to have a firing cycle not initiated by the prior trigger pull. Also, electric trigger mechanisms require an onboard battery to operate the circuitry. The requirement for onboard battery power adds a maintenance issue to the marker, and an additional performance factor (battery charge state) that must be monitored during the course of a game.

Although the above identified devices may be useful for their intended purposes, it is beneficial in the field to have an alternative marker gun trigger mechanism having a trigger pull requiring very low force and having short travel. It would be additionally beneficial if the alternative trigger mechanism did not require battery power and was fully compliant with the above definition of "semiautomatic" firing rate.

SUMMARY OF THE INVENTION

The present invention is a pneumatic trigger mechanism having a special pneumatic amplifier valve. The pneumatic trigger mechanism is intended for use with gas powered projectile guns, and specifically for such gas powered paintball markers. The present pneumatic trigger mechanism utilizes a specialized pneumatic force amplifier which substantially improves trigger performance and cycle time over prior mechanical and pneumatic marker gun trigger mechanisms. The pneumatic amplification feature of the present trigger actuator is double acting, in that it provides an increased force advantage for both the firing phase and trigger return phase of the firing cycle. Performance wise, the pneumatically amplified valving of the present trigger actuator only requires about 2 oz. of force and as little as 0.01 inch of travel to activate it.

The present pneumatically operated trigger mechanism comprises a trigger sensor valve and a pneumatically amplified actuator. The trigger sensor valve is in gas flow communication with an external gas pressure source, with atmosphere and with the pneumatic amplifier actuator. The trigger sensor valve is in gas flow communication with the pneumatically amplified actuator via a pressure extension chamber. The pneumatic actuator is mechanically linkable to the firing mechanism of a gun. The intended gun is a gas operated paintball marker, but the present trigger mechanism is practicable in other types of guns as well, particularly gas supply operated guns.

The trigger sensor valve of the present pneumatically operated trigger mechanism senses the condition of the trigger of the gun, i.e., whether the trigger is being pulled or is released. The trigger sensor comprises a trigger valve body which houses a trigger rod, a load chamber and two pneumatic valve assemblies: a poppet valve assembly and a vent valve assembly. The poppet valve assembly is normally closed (to gas pressure flow). When open, the poppet valve assembly allows gas from the external supply to flow into and to pressurize the load chamber and any communicating spaces. The vent valve is normally open, and when closed, prevents the gas charge in the load chamber (and connecting spaces) from venting to atmosphere. The trigger rod slides into the trigger valve body through the housing of the vent valve and extends into the lumen of the pressure load chamber inside the trigger valve body. The trigger rod is specifically designed to operate both the poppet valve and the vent valve. The vent valve, including a vent space/chamber and a vent valve seal, is received at a first end of the interior load chamber. The vent valve housing serves as a rod guide for receiving the trigger rod as it passes into the trigger valve body. The external or trigger contact end of the trigger rod extends outside the trigger valve body and is in mechanical communication with the trigger of the gun. A shoulder portion on the trigger rod (proximate a mid-section of the trigger rod) serves as the vent seat for the vent valve. Normally, the vent valve is open with the vent seat displaced from the vent seal allowing the load chamber to vent to atmosphere through the vent space and a vent port in the housing.

The poppet valve assembly is received in the second end of the interior load pressure chamber. The poppet valve assembly is in gas flow communication with an external (to the trigger mechanism) gas pressure source. The poppet valve assembly includes a poppet housing, a poppet and a poppet seal. Normally the poppet valve is closed with the poppet held against the poppet seal. The normal condition for the present trigger actuator is when the trigger of the gun is not depressed or being depressed, i.e. the trigger rod is maximally extended externally from the trigger sensor valve. The trigger rod has a poppet contact end at its farthest point of insertion into the load chamber. The poppet contact end closely interfaces with the poppet of the poppet valve assembly. Depressing the trigger contact end of the trigger rod (e.g., by squeezing the trigger of the gun) causes the trigger rod to displace the poppet from its seat and open the poppet valve, and to close the vent valve by seating the rod shoulder against the vent seat.

The pneumatically amplifier actuator of the present pneumatically amplified trigger actuator mechanism is not a pneumatic valve in that it does not switch or direct gas flow to different paths or valve ports. The pneumatic amplifier actuator comprises an actuator body housing an actuator chamber. The actuator chamber is in gas flow communication with trigger sensor valve via a pressure chamber extension. A ram piston assembly is slideably received in the actuator chamber. The ram piston assembly includes a ram piston with a piston head at one end and an actuator arm at the other end. The distal end of the arm extends externally from the actuator chamber and actuator housing. Normally, the piston head of the ram piston is retracted into the actuator chamber. The pneumatic actuator transmits movement of the ram piston to the firing mechanism of the gun. The pressure extension chamber connects the load chamber of the trigger sensor valve assembly to the actuator chamber of the trigger actuator assembly.

The firing cycle of the present pneumatically amplified trigger actuator consists of a firing phase and a trigger return phase. The firing phase is initiated when the trigger rod is moved from its normal position, causing the poppet valve to opened and the vent valve to closed. Upon opening of the poppet valve, gas at pressure enters the load chamber. Because the vent valve is closed, the gas at pressure passes through the pressure extension chamber to charge the actuator chamber of the pneumatic actuator. Upon the actuator chamber becoming charged, the normally retracted actuator arm of the piston ram is forced, against a ram piston return bias, to move/extend from the actuator chamber. The actuator arm being linkable to the firing mechanism of a gun, it can trip the firing mechanism upon its movement. The extension of the actuator arm from the actuator chamber persists until the trigger is released.

The trigger return phase is initiated upon the subsequent release of the trigger (i.e., removing the external pressure on the trigger rod). Upon release of the trigger, force from the poppet return bias means (e.g., a return spring) pushes the poppet against the trigger rod end, causing the trigger rod to return to its normal position. Returning the trigger rod to its normal position allows the poppet valve to close and the vent valve to open. Opening the vent valve allows the pressurized gas within the various internal chambers or spaces of the present pneumatic trigger mechanism to vent to atmosphere. As the internal gas pressure drops, the force of the ram piston return bias, which had been overcome by the pressurization of the actuator chamber, mechanically assists the venting of gas from the chamber as the gas pressure drops sufficiently to allow the ram return bias to be effective. The biased force of the ram piston returning to normal amplifies the otherwise passive venting of gas pressure from the present pneumatic trigger actuator. This amplification of the passive venting force decreases the cycle time otherwise required to return the trigger actuator to normal, and ready for initiating the next firing cycle.

DETAILED DESCRIPTION OF THE INVENTION

Figure 1A:
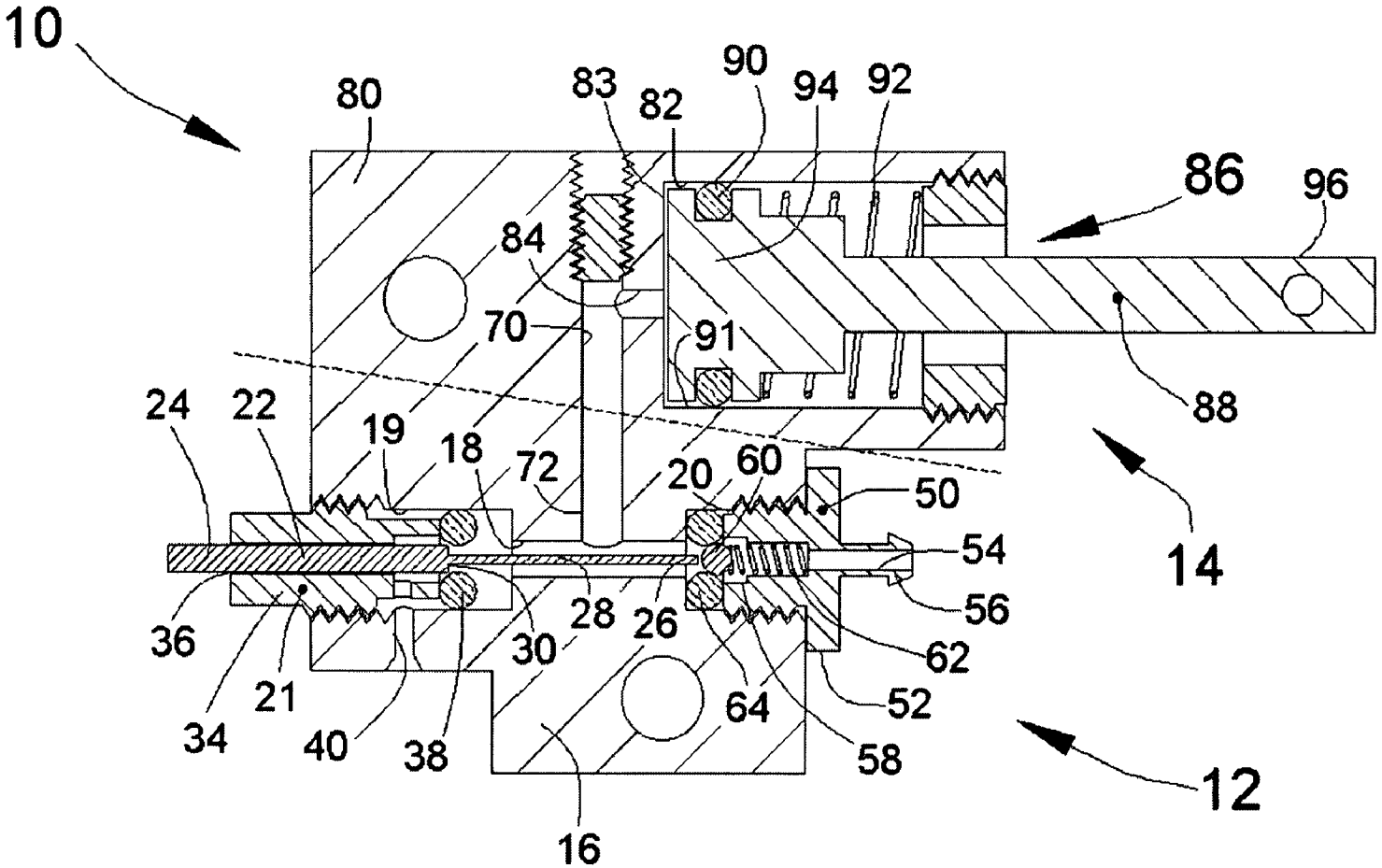
FIG. 1A is a cross-sectional diagram of the present pneumatically operated trigger mechanism showing the trigger sensor valve and the pneumatic amplifier actuator integrated into a single housing unit, and illustrating the relationship of the components in their normal (non-triggered) condition.

Referring now to the drawings, the details of preferred embodiments of the present invention are graphically and schematically illustrated. Like elements in the drawings are represented by like numbers, and any similar elements are represented by like numbers with a different lower case letter suffix.

Figure 1B:
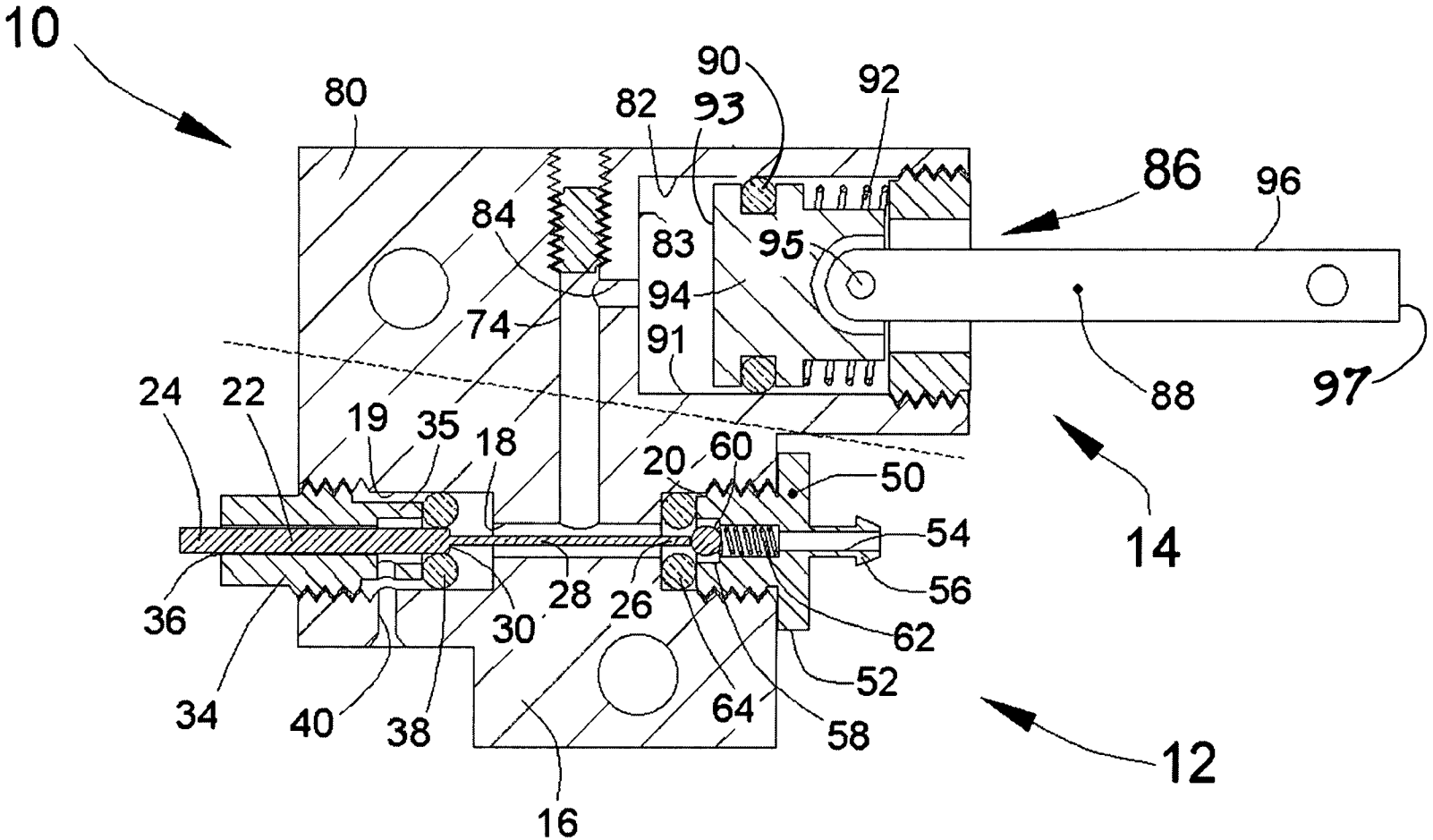
FIG. 1B is a cross-sectional diagram of the present trigger mechanism of FIG. 1A, but illustrating the relationship of the components in their triggered condition.
Figure 3:
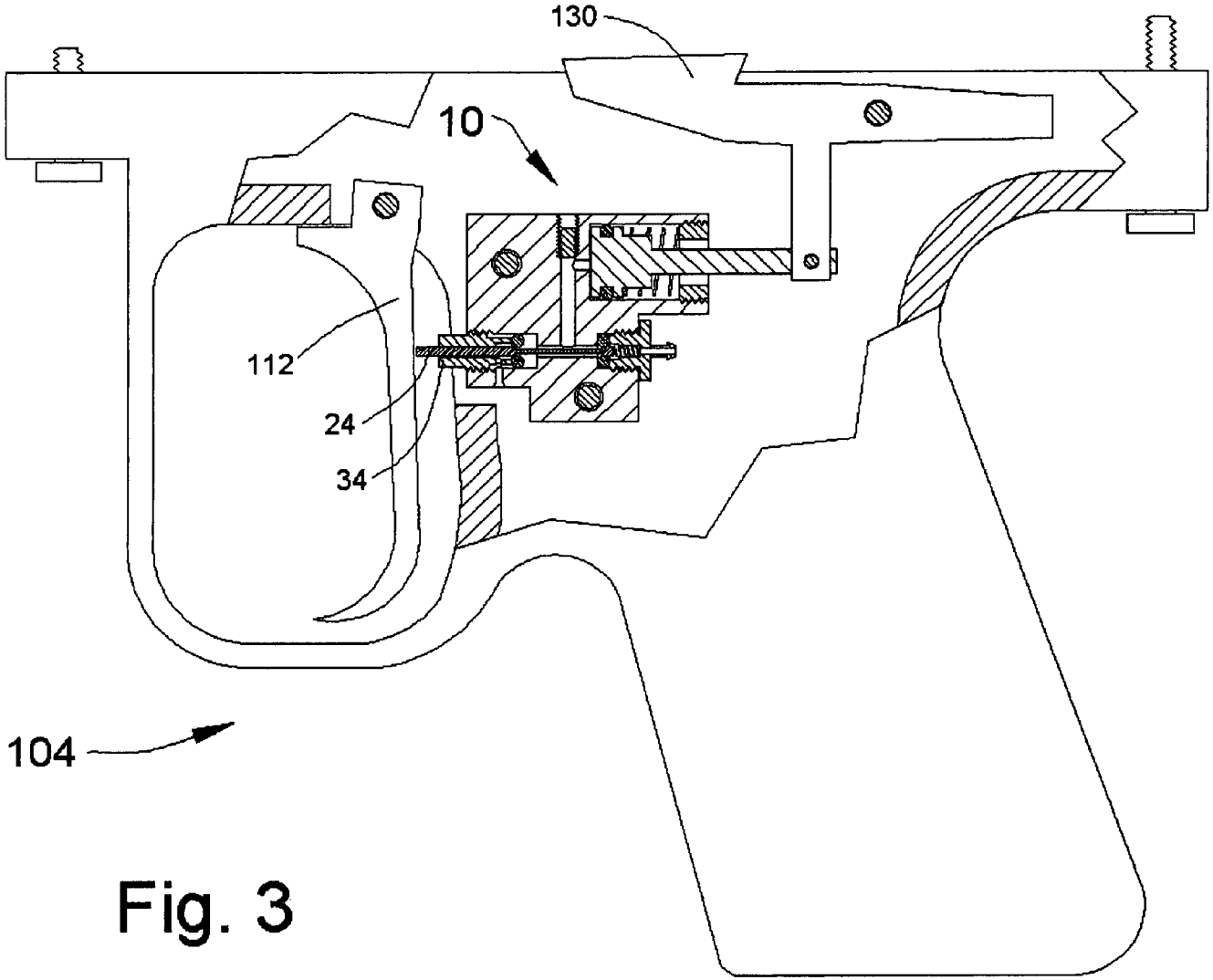
FIG. 3 is a partial cross-sectional diagram of a trigger housing typical of a paintball marker gun illustrating the relationship of the present pneumatically operated trigger mechanism to the trigger and trigger sear of the embodiment.

As illustrated in the figures, the present invention is a pneumatically operated trigger mechanism 10 intended for use with gas powered projectile guns, and specifically for such gas powered paintball markers. Generally, the present pneumatically operated trigger mechanism 10 comprises two main components: a master control component and a slave actuator component. The master component controls the operation of the slave component. More specifically, in the preferred embodiment illustrated in the figures, the master control component is a trigger sensor valve 12 and the slave actuator component is a pneumatic amplifier actuator 14. As illustrated in FIGS. 1A and 1B, the trigger sensor valve 12 is in gas flow communication with an external gas pressure source (not shown), with atmosphere, and with the pneumatic amplifier actuator assembly 14. In turn, the pneumatic actuator 14 is mechanically linked to the firing mechanism 130 of the gun 104 (see FIG. 3) for which it is the trigger mechanism. In use, the present pneumatically amplified trigger mechanism 10 may be considered to have two operational phases definable by the trigger of the gun being pressed, i.e., the firing phase, or the trigger of the gun being released, i.e., the trigger return phase.

The trigger sensor valve 12 comprises a trigger valve body 16, which houses an interior pressure load chamber 18, a vent valve receiver 19 at a first chamber end of the load chamber 18, and a poppet valve receiver 20 at a second chamber end of the load chamber 18. A vent valve assembly 21 is disposed in the vent valve receiver 19, and a poppet valve assembly 50 is disposed in the poppet valve receiver 20. In a preferred embodiment, as exemplified in the figures, the vent valve assembly 21 and the poppet valve assembly 50 were threaded and screwed into complementary threads on their respective receivers 19 & 20. Other means for disposing the vent valve assembly 21 and the poppet valve assembly 50 into their respective receivers 19 & 20 are known to and selectable by the ordinary skilled artisan for practice in the present invention. For example, the vent valve assembly 21 and the poppet valve assembly 50 can be press fitted into their respective receivers 19 & 20. However, in the preferred embodiment illustrated, having the vent valve assembly 21 threadably received into the valve body 16 of the trigger sensor valve 12 provided a mechanism for adjusting or tuning the performance of the present pneumatic trigger mechanism 10, as explained below. To accomplish the tuning feature, the rod guide receiver 19 had internal threads and the trigger rod guide 34 has external complementary threads which allowed the rod guide 34 to be screwed into the vent receiver 19, and as illustrated in FIGS. 1A and 1B, the vent housing/rod guide 34 was adjustable as to a depth it could be screwed into the rod guide receiver 19.

The vent valve assembly 21 comprised a vent housing 34 which also served as a guide for the trigger rod 22. The trigger rod guide 34 has a first trigger end 31 and a second vent end 32 and a rod guide bore 36. The rod bore 36 slideably receives the trigger rod 22 proximate the trigger contact end 22 and holds the trigger rod 22 inline with the poppet 60 of the poppet valve assembly 50. The trigger rod 22 slides into the trigger valve body 12 through the rod guide bore 36 in the vent valve housing 34, and extends into the lumen of the pressure load chamber 18 inside the trigger sensor valve body 16. The trigger rod 22 had a trigger contact first end 24, a poppet contact second end 26, and a vent seat 30 disposed proximate a mid-section 28 of the trigger rod 22. The trigger contact end 24 of the trigger rod 22 extends outside the valve body housing 16, with the face of the trigger contact end 24 in mechanical communication with the trigger 112 of the gun 200 (see FIG. 3). A shoulder portion on the trigger rod 22 (proximate a mid-section 28 of the trigger rod 22) serves as the vent seat 30 for the vent valve assembly 21. The vent valve assembly 12 is normally open, with the vent seat 30 displaced from the vent seal 38 as shown in FIG. 1A. The vent valve assembly 12 being open allows the load chamber 18 to vent to atmosphere through the vent space/chamber 42 and a vent port 40 in the valve housing 16.

The rod bore 36 terminates at the vent end 35 of the rod guide 34 in a vent space/chamber 42 (see FIG. 1A). The vent space seal 38 contacts the vent end 35, and the vent seal 38 in combination with the vent seat 30 on the trigger rod 22 can selectively close or open the vent space 42 to communication with the pressure load chamber 18. Normally, during the trigger return phase, the vent seat 30 is displaced from the vent seal 38, and the pressure load chamber 18 is vented to atmosphere via vent space 42 and vent port 40. The vent assembly 21 is held normally open by a bias force applied to the poppet end 26 of the trigger rod 22 by the poppet valve assembly 50.

The poppet valve assembly 50 is disposed in the poppet valve receiver 20 in a manner similar to that for receiving the vent valve assembly 21 into its receiver 19. The poppet valve assembly 50 is in gas flow communication with an external gas pressure source (not shown) via the gas pressure input passage 54 of a gas fitting 56. The poppet valve assembly 50 additionally comprises a poppet housing 50, a poppet 60 and a poppet seal 64. The poppet valve assembly 50 is normally closed to gas flow by the poppet 60 being held against the poppet seal 64 by a poppet bias means 62. In the preferred embodiment shown in the figures, the poppet bias means was a poppet return spring 62.

The poppet housing 50 has a through gas pressure supply port 54. The gas pressure supply port has a first supply port end 56 connectable to an appropriate external gas pressure source, and a second supply port end 58 comprising a poppet receiver 59. In the preferred embodiment illustrated in the figures, the poppet receiver 59 comprised a chamber in which a poppet 60 and a poppet return bias means 62 were disposed. In the preferred embodiment illustrated, the poppet 60 was a ball and the poppet return bias means 62 was a spring. The poppet return spring 62 disposed in the poppet receiver 59 in combination with the poppet 60 provided a biasing force to normally hold the poppet 60 against the poppet valve seal 64 and to return the trigger rod 22 to its normal configuration of disengaged from the vent valve seal 38 and extended from the trigger sensor valve body 16.

The trigger rod 22 has a poppet contact end 26 at its farthest point of insertion into the load chamber 18. The poppet contact end 26 of the trigger rod 22 closely interfaces with the poppet 60 of the poppet valve assembly 50. Operationally, the normal condition for the present trigger actuator 10 is as shown in FIG. 1A, wherein the trigger 112 of the gun 200 is not depressed or in the process of being depressed, i.e. the trigger rod 22 is maximally extended externally from the trigger valve body 16. Depressing trigger 112 of the gun 200 against the trigger contact end of the trigger rod (e.g., by squeezing the trigger of the gun) initiates the firing phase of the present trigger actuator 10. Depressing the trigger 112 causes the trigger rod 22 to displace the poppet 60 from its seal 64 and opens the poppet valve to allow gas pressure flow to charge the load chamber 18. In operation, when the trigger 112 of the gun 104 is pressed/pulled, the trigger rod 22 is moved inward of the valve housing 34, and the firing phase is initiated as shown in FIG. 1B. Inward movement of the trigger rod 22 sufficient to close the vent valve assembly 21 by seating the rod shoulder 30 against the vent seal 38 is intended to, as close to simultaneously as possible, also open the poppet valve assembly 50. On initiation of the firing phase (FIG. 1B), the timing relationship between the closing of the vent valve assembly 21 and the opening of the poppet valve assembly 50 is important in the maximization of the cycling efficiency to the present pneumatically amplified trigger actuator mechanism 10, as will be discussed below.

When the poppet valve 50 is opened, gas flow pressure charges the pressure load chamber 18 of the trigger sensor valve assembly 12. The gas flow pressure charge in the load pressure chamber 18 is transmitted to the pressure chamber extension 70 (see FIGS. 1A and 1B). This is accomplished by the pressure chamber extension 70 having a first extension end 72 in gas pressure communication with the pressure load chamber 18. In the preferred embodiment illustrated, the first extension end 72 was disposed on the load chamber 18 between the rod guide receiver 19 and the poppet valve receiver 20. The pressure chamber extension 70 also had a second extension end 74 terminating in an actuator port 84 of the pneumatic actuator 14. The pressure chamber extension 70 is in gas pressure flow communication with the actuator chamber 82 of the pneumatic actuator 14 via the actuator port 84.

The pneumatic amplifier actuator 14 of the present trigger mechanism 10 comprises an actuator body 80 which houses the actuator chamber 82. The actuator port 84 is disposed proximate a first end 83 of the actuator chamber 82 and completes the gas flow communication path between the pressure load chamber 18 of the trigger sensor valve 12 and the actuator chamber 82 of the pneumatic actuator 14. A ram piston assembly 86 is slidably received in the actuator chamber 82. The ram piston assembly 86 includes a ram piston 88, a piston gas seal means 90 and a ram return bias means 92. The ram piston 88 has a first piston head end 94 slideably received in the actuator chamber 82 and a second actuator arm end 96 extending externally from the actuator chamber 82.

Figure 2B:
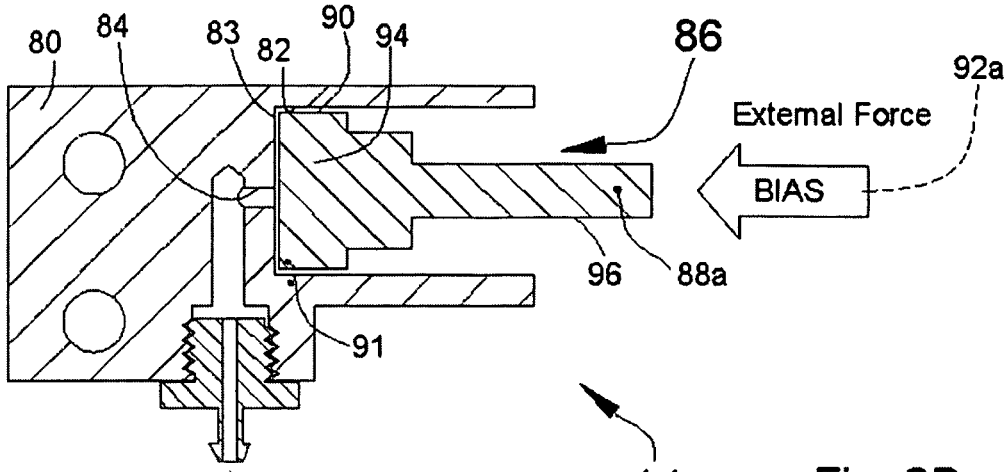
FIGS. 2A and 2B are cross-sectional diagrams of the present pneumatically operated trigger mechanism showing the trigger sensor valve and the pneumatic amplifier actuator comprising separate housing units, and illustrating the relationship of the components in their normal (non-triggered) condition, and showing the piston assembly being returned to its illustrated position in the housing by an external piston return bias means.

In the preferred embodiment illustrated in FIG. 1A, the piston gas seal means was an "O"-ring disposed between the piston head 94 and the interior actuator chamber wall 91 to provide a sliding gas seal feature. A benefit of this configuration of a ram piston assembly and gas seal means combination was that it allowed some angular displacement of the centerline of the piston head and arm from the centerline of the actuator chamber without substantially compromising performance of the actuator mechanism 14. Other configurations of the ram piston assembly and gas seal means combination are selectable by the ordinary skilled artisan for practice in the present invention in view of the teachings and figures contained herein. For example, as illustrated in FIG. 1B, the piston head 94 and/or the interior chamber wall 91 can be lined with or constructed from low friction materials (e.g., TEFLON®) and closely interfaced to provide an equivalent sliding gas seal feature. If a sliding gas seal feature is somewhat leaky relative to the same feature illustrated in FIG. 1A, the gas flow pressure supply from the external gas pressure source may be adjusted to compensate. Alternatively, the dimensional parameters of the gas pressure flow path may be adjusted to compensate as well. Either or both of these alternatives are practicable in the present trigger actuator mechanism 10 without undue experimentation by one of skill in the art. As shown in FIG. 1B, the piston arm 86 may articulate relative to the piston head 94 via an articulation means 95. Articulation 95 means other than the pivot means shown in FIG. 2B are known to and are practicable in the present invention by the ordinary skilled artisan, such as a ball and socket articulation means (not shown).

It is intentional that the cross-sectional area of the piston face 93 is substantially greater that the arm cross-section 97 of the actuator arm 96. This area relationship is a factor of the one of the dual amplification features of the pneumatic amplifier actuator 14. That is that an appropriately greater area of the piston face 93 imparts a greater force to the piston arm 96 for a given gas pressure charge at the activator gas port 84.

A return bias means is included to provide a force to normally hold the piston head 94 of the ram piston 88 proximate the first end 83 of the actuator chamber 82. Additionally, the return bias means provides a force to return the piston head 94 of the ram piston 88 to its normal position proximate the first end 83 of the actuator chamber 82 after the firing phase is terminated by the trigger 112 of the gun 200 being released. In the preferred embodiment illustrated in FIGS. 1A and 1B, the return bias means was a piston return spring 92. Other return bias means are known to and practicable in the present invention by the ordinary skilled artisan. For example, FIG. 2B illustrates the piston head 94 of the piston assembly 86 being returned to its normal position proximate the first end 83 of the actuator chamber 82 by an external piston return bias means 92*a*. This aspect of the present trigger actuator mechanism 10 is useful in those applications where there is an appropriate bias (in force and direction) available from the firing mechanism of the gun in which the present trigger actuator mechanism 10 is being used. Additionally, a combination of an internal and an external piston return biasing means may be used. As noted elsewhere, the return bias is means is an aspect of the pneumatic amplification feature of the present invention, in that energy represented by the return bias force acts to accelerate venting to atmosphere the internal pressure in the actuator chamber 82.

Figure 2A:
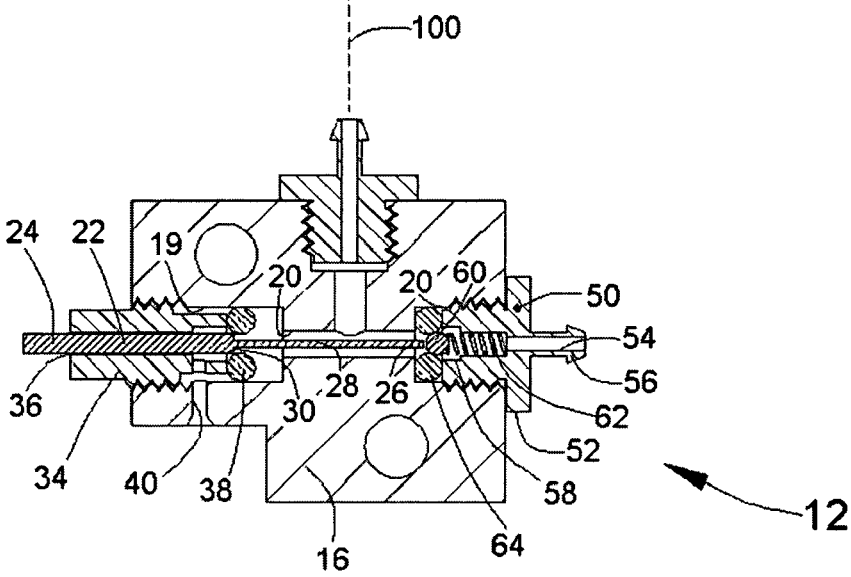

In the preferred embodiment shown in FIGS. 1A and 1B, the trigger sensor valve 12 and the pneumatic amplifier actuator 14 of the present pneumatically operated trigger mechanism 10 were integrated into a single body or housing. In an other preferred embodiment illustrated in FIGS. 2A and 2B, the trigger sensor valve 12 and the pneumatic amplifier actuator 14 each comprise a separate housing in gas flow communication via an external gas pressure flow conduit 100.

Hysteresis Adjustment

The present pneumatically amplified trigger actuator 10 includes an adjustment capability to tune out the variability that can be introduced into the apparatus by inherent variability between parts and the assembly process. This is called the hysteresis adjustment, and is accomplished using the housing/rod guide 34 of the vent valve assembly 21.

Figure 4:
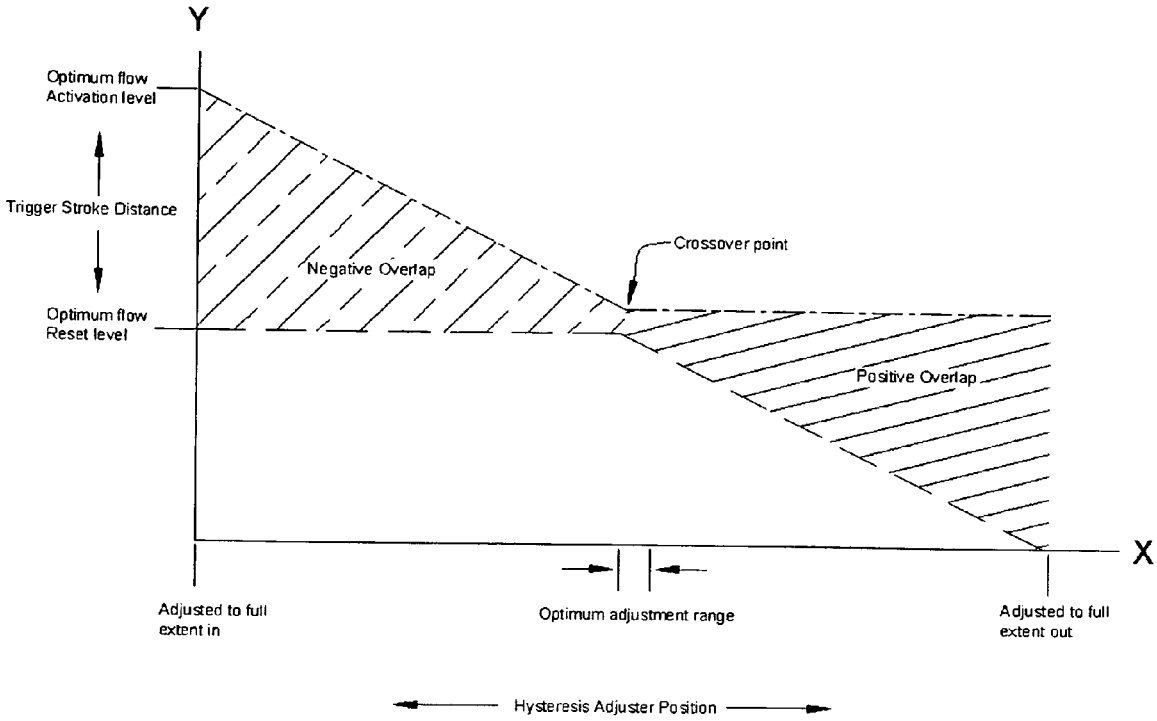
FIG. 4 is a graph depicting the relationship of trigger stroke (between activation and reset positions) and the positioning of the hysteresis adjuster.

The Graph of FIG. 4 depicts relationship between the trigger stroke (between activation and reset positions) and the position of the hysteresis adjuster/rod guide 34. Dimension Y depicts the trigger stroke and dimension X depicts the hysteresis adjuster position. Since it is advantageous to have a trigger throw that is as short as possible, the distance necessary to move the trigger between its activation position (initiation of firing phase) and its reset position (trigger return phase) should be as short as possible. To achieve this, the hysteresis adjuster 34 should be set to within the Optimum Adjustment Range, which is as close to the crossover point in the graph as possible, while still remaining in the positive overlap area. If the hysteresis adjuster 34 is set so that the trigger rod 22 is operating in the negative overlap area, then unwanted continuous venting of pressure can occur while moving the trigger rod 22 between activation and reset positions. If the hysteresis adjuster 34 is set so that the trigger rod 22 is operating too far into the positive overlap area, unnecessary excessive trigger throw will result.

At the crossover point, there is a theoretical point where activation and reset can occur almost simultaneously (i.e., with a 0.003" throw of trigger). The optimum flow activation level and optimum flow reset levels depicted in Graph of FIG. 4 do not meet at a point at the crossover point because these lines depict the optimum flow rates, which are a certain required amount of rod throw past the theoretical point in both the Activation and the Reset directions where optimum flow rate is achieved.

Engineering

The present pneumatically amplified trigger actuator mechanism 10 is engineered in consideration of a number of parameters in order to achieve the performance goals of a lightweight and short throw trigger and rapid cycle rate. These parameters must be incorporated into the design and implementation of a particular amplifier/booster. Some of the performance considerations in a design implementation include: maximization of potential rate of fire; trigger pull activation force v. trigger return force; trigger throw v. trigger pull weight; and input pressure. Based on these performance goals, the valve is then designed to minimize the trigger throw and pull weight while reducing firing cycle time.

This is accomplished via the following steps:

1. calculate required piston size needed to activate the gun based on the input pressure.
2. calculate the airflow needed to activate the piston in a manner that activates the gun within the time period required to meet the max rate of fire requirement.
3. Adjust the airflow and piston size requirements to accommodate the biases in the system during activation and return operation.
4. design the valve to have the smallest possible travel and return pressure while maintaining the necessary flow rates at the given input pressure. The travel and activation force must be balanced against each other based on user preference or a ratio determined acceptable by the designer.

After the valve is designed to accommodate the requirements of a specific implementation, the valve can be fine tuned by adjusting the input pressure. Increased pressures will provide a diminishing gain in faster cycle times, until the additional pressure begins to slow cycle times by taking too long to vent during the return stage. Increasing pressure also has the negative effect of increasing trigger activation weight.

A key feature that gives rise to an unusual benefit of the trigger sensor valve 12 is its hysteresis adjustment which provides a means for a user to adjustable the overlap point of the vent and poppet valve assemblies 19 & 50. This adjustability feature enables a user to tune the firing cycle of the present pneumatic trigger actuator mechanism 10 to his/her own preference or feel. Although a production type pneumatic valve can be designed to have a very short throw, manufacturing, material tolerances and economic considerations force producers to build-in a significant margin of error between the activation and venting operations. In part the problem is that as shortening the stroke to bring the activation and ventilation thresholds to the two components of the valve closer together, the risk increases of the valve simultaneously connects to the pressure source and pressure vent. Additionally, inherent variances of valve components like seats and seals, compounded with the introduced variances of time and wear, can substantially reduce the performance of even a custom designed and produced trigger valve, absent the ability to tune the valve over time or after replacement of valve components.

At one extreme of the hysteresis adjustment range, the valve will have a longer than necessary activation stroke. At the opposite end of the adjustment range, the seats will simultaneously open and connect the pressure source with the pressure vent, thus causing a continuous leak condition. An optimally tuned valve will be adjusted very close to the crossover point between these extremes. Since this point is a moving target over time, it is very useful to have a present hysteresis adjuster to tune out unwanted variation. In the preferred embodiment illustrated in the figures, the hysteresis adjuster, which is the housing 34 of the vent valve assembly 19, solves this problem by enabling a user to adjust the throw of the trigger rod 22 at any time to suit his/her individual preference.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A pneumatically operated trigger mechanism comprising: a trigger sensor valve in gas flow communication with an external gas pressure source, with atmosphere, and with a pneumatic amplifier actuator, and the pneumatic amplifier actuator in mechanical communication with a firing mechanism of a gun.

2. The pneumatically operated trigger mechanism of claim 1, wherein the trigger sensor valve comprises:

a trigger valve body having an interior pressure load chamber, the load chamber having a vent valve receiver at a first chamber end and a poppet valve receiver at a second chamber end;

a trigger rod extending into the load chamber through a rod bore in a rod guide, the trigger rod having a trigger contact first end, a poppet contact second end and a vent seat disposed proximate a mid-section of the trigger rod;

a trigger rod guide disposed in a rod guide receiver, the rod guide having a first trigger end and a second vent end and a through rod bore, the rod bore slideably receiving the trigger rod proximate the trigger contact end and holding the trigger rod inline with a poppet, and the rod bore terminating at the vent end in a vent space with a vent space seal contacting the vent end, the vent space communicating via a vent port with atmosphere and venting the pressure load chamber to atmosphere when the vent seat is displaced from the vent seal;

a poppet valve assembly disposed in the poppet valve receiver, the poppet valve assembly in gas flow communication with the external gas pressure source; and a pressure chamber extension having a first extension end in gas pressure flow communication with the pressure load chamber, the first extension end disposed on the load chamber between the rod guide receiver and the poppet valve receiver, and having a second extension end in gas pressure flow communication with the pneumatic amplifier actuator.

3. The trigger sensor valve of claim 2, wherein the poppet valve assembly comprises:

a poppet housing having a through gas pressure supply port, the gas pressure supply port having a first supply port end connectable to an appropriate external gas pressure source, and a second supply port end having a poppet receiver, and interfacing with a poppet valve seal; and a poppet and a poppet return bias means disposed in the poppet receiver to normally hold the poppet against the poppet valve seal and provide a normally closed poppet valve assembly.

4. The trigger sensor valve of claim 2, wherein the poppet valve receiver has internal threads and the poppet valve assembly has external complementary threads and screws into the poppet valve receiver.

5. The trigger sensor valve of claim 2, wherein the rod guide receiver has internal threads and the trigger rod guide has external complementary threads and screws into the rod guide receiver.

6. The trigger sensor valve of claim 2, further comprising a hysteresis adjuster means, the adjuster means being the rod guide receiver having internal threads and the trigger rod guide having external complementary threads and the rod guide screws into the rod guide receiver to a depth, and the depth to which the rod guide screws into the rod guide receiver is adjustable.

7. The pneumatically operated trigger mechanism of claim 1 wherein the pneumatic amplifier actuator assembly comprises:

an actuator body housing an actuator chamber, the actuator chamber having a load pressure port disposed proximate a first actuator chamber end, the load pressure port in communication with the pressure chamber extension; and a ram piston assembly slidably received in the actuator chamber, the ram piston assembly including a ram piston, a piston gas seal and a return bias means, the ram piston having a first piston head end received in the actuator chamber and a second actuator arm end extending externally from the actuator chamber, the piston gas seal being disposed between the piston head end and an interior actuator chamber wall and providing a sliding gas seal, and the return bias means disposed to provide a force to normally hold the piston head of the ram piston proximate the first actuator chamber end.

8. The pneumatically operated trigger mechanism of claim 1, wherein the trigger sensor valve and the pneumatic amplifier actuator each comprise a separate housing in gas flow communication with each other via an external gas pressure flow conduit.

9. The pneumatically operated trigger mechanism of claim 1, wherein the trigger sensor valve and the pneumatic amplifier actuator comprise housings that are integral with each other.

10. A pneumatically operated trigger mechanism comprising:

a trigger sensor valve for sensing the movement of a gun trigger, the trigger sensor valve having an internal gas pressure load space, the pressure load space having a gas pressure flow input path through a normally closed poppet valve assembly and a gas pressure flow vent path to atmosphere through a normally open vent valve assembly;

a trigger sensor valve rod disposed in the trigger sensor valve, the valve rod transmitting movement of the gun trigger to the trigger sensor valve to initiate a firing cycle by substantially simultaneously altering the normal conditions of the poppet valve assembly and the vent valve assembly to enable gas flow pressure from an external source to cause a gas pressure charge the internal gas pressure load space;

a valve timing adjuster integral with the vent valve assembly, the valve timing adjuster for tuning the simultaneity of the altering of the poppet valve and vent valve assemblies from their normal conditions; and a pneumatic amplifier actuator having an externally acting actuator ram having an arm end linkable to a firing mechanism of the gun and an enlarged piston head end slideably disposed in an actuator pneumatic piston chamber, the piston chamber being in gas pressure flow communication with the internal gas pressure load space, actuator ram sliding in the piston chamber in response to the gas pressure charge in the pressure load space against a normally opposing ram bias, the sliding of the piston arm tripping the firing mechanism of the gun.

* * * * *